US006280155B1

(12) United States Patent
Dreiman

(10) Patent No.: US 6,280,155 B1
(45) Date of Patent: Aug. 28, 2001

(54) DISCHARGE MANIFOLD AND MOUNTING SYSTEM FOR, AND METHOD OF ASSEMBLING, A HERMETIC COMPRESSOR

(75) Inventor: Nelik I. Dreiman, Tipton, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/531,955

(22) Filed: Mar. 21, 2000

(51) Int. Cl.[7] ..... F04B 17/00
(52) U.S. Cl. ..... 417/410.5
(58) Field of Search ..... 417/410.5, 368; 418/55.1

(56) References Cited

U.S. PATENT DOCUMENTS

| | | | | |
|---|---|---|---|---|
| 4,767,293 | | 8/1988 | Caillat et al. . | |
| 4,877,382 | | 10/1989 | Caillat et al. . | |
| 4,929,160 | | 5/1990 | Inoue . | |
| 4,992,033 | | 2/1991 | Caillat et al. . | |
| 5,042,150 | | 8/1991 | Fraser, Jr. . | |
| 5,055,010 | | 10/1991 | Logan . | |
| 5,114,322 | | 5/1992 | Caillat et al. . | |
| 5,137,437 | | 8/1992 | Machida et al. . | |
| 5,141,417 | | 8/1992 | Bush . | |
| 5,176,506 | | 1/1993 | Siebel . | |
| 5,219,281 | | 6/1993 | Caillat et al. . | |
| 5,232,351 | * | 8/1993 | Robertson et al. | 417/368 |
| 5,288,211 | * | 2/1994 | Fry | 417/312 |
| 5,312,234 | | 5/1994 | Yoshii . | |
| 5,320,507 | * | 6/1994 | Monnier et al. | 418/55.6 |
| 5,328,340 | | 7/1994 | Hara et al. . | |
| 5,342,183 | | 8/1994 | Rafalovich et al. . | |
| 5,354,184 | | 10/1994 | Forni . | |
| 5,358,391 | | 10/1994 | Wallis et al. . | |
| 5,374,166 | | 12/1994 | Fukui . | |
| 5,385,453 | * | 1/1995 | Fogt et al. | 417/410.5 |
| 5,427,511 | | 6/1995 | Caillat et al. . | |
| 5,445,507 | | 8/1995 | Nakamura et al. . | |
| 5,447,415 | | 9/1995 | Fukui . | |
| 5,476,371 | * | 12/1995 | Dreiman | 417/550 |
| 5,503,542 | * | 4/1996 | Grassbaugh et al. | 418/55.1 |
| 5,557,845 | | 9/1996 | Burkett et al. . | |
| 5,564,186 | | 10/1996 | Hori et al. . | |
| 5,584,676 | * | 12/1996 | Dreiman | 417/569 |
| 5,593,294 | * | 1/1997 | Houghtby et al. | 418/5.1 |
| 5,649,816 | | 7/1997 | Wallis et al. | 418/55.1 |
| 5,661,894 | | 9/1997 | Kawasaki et al. | 29/596 |
| 5,667,371 | | 9/1997 | Prenger et al. | 418/55.1 |
| 5,674,062 | | 10/1997 | Weatherston | 418/55.1 |
| 5,745,992 | | 5/1998 | Caillat et al. | 29/888.022 |

* cited by examiner

*Primary Examiner*—Teresa Walberg
*Assistant Examiner*—Vinod D Patel
(74) *Attorney, Agent, or Firm*—Baker & Daniels

(57) ABSTRACT

A compressor assembly includes a housing and a compressor mechanism is disposed therein which is partially supported by a manifold. The manifold extends across the interior of the housing, has an aperture therethrough, and subdivides the interior of the housing into a first discharge chamber and a second discharge chamber. An electric motor is disposed in the second discharge chamber and includes a stator and a rotor. A shaft operatively couples the compressor mechanism with the rotor. The manifold includes an aperture into which is received a discharge gas into the first discharge chamber and a plurality of chutes to direct the discharge gas into the second discharge chamber. The chutes are in fluid communication with an exterior of the compressor mechanism defining passages therebetween. The housing includes a main section and an end section which respectively include edges. A bearing support member extends across an interior of the housing and is supported between the edges of the main and end sections of the housing. The bearing support member has portions which project radially outward. An auxiliary bearing is supported by the bearing support member and the auxiliary bearing rotatably supports the shaft. A method of assembly includes: attaching the compressor mechanism to the manifold and welding the manifold to the housing; attaching the stator to the housing and the auxiliary bearing to the bearing support member; aligning the main bearing with the stator and welding the bearing support member to the housing.

34 Claims, 8 Drawing Sheets

DISCHARGE MANIFOLD AND MOUNTING SYSTEM FOR, AND METHOD OF ASSEMBLING, A HERMETIC COMPRESSOR

BACKGROUND OF THE INVENTION

The present invention relates generally to hermetic compressors for use in cooling, refrigeration or air-conditioning systems, and more particularly to hermetic scroll compressors.

Well known to those having skill in the art are hermetic scroll compressors such as compressor 10 of FIG. 1, having a closed hermetic housing 12 comprised of cylindrical section 14 with end cap 16 welded at the upper end thereof and base 18 at the lower end thereof. Base 18 includes a plurality of mounting feet 20. Compressor 10 has electric motor 22, which comprises stator 24 fixed inside cylindrical section 14 by, for example, shrink-fitting. Surrounded by stator 24 is rotor 26, which is attached to shaft 28 by, for example, press-fit. Counterweight 27 is attached to an upper end of shaft 28 and counterweight 31 is attached to rotor 26, as is customary, to provide substantially balanced rotation of shaft 28. Shaft 28 is coupled to orbiting scroll 30 through eccentric 29. Shaft 28 is supported, at opposing ends thereof, by bushing 32 and auxiliary bearing 34. Bushing 32 is fixed within main bearing 48 by, for example, press-fit. Main bearing 48 and auxiliary bearing 34 are rigidly affixed to an internal surface 33 of cylindrical section 14 of housing 12 typically by press-fit or spot weld methods. Generally, auxiliary bearing 34 includes a plurality of outwardly extended legs 36 secured to internal surface 33 of cylindrical section 14.

Those having skill in the art of compressor construction readily appreciate that spot welding, although a preferable manufacturing process to attach the bearings to the housing, may cause heat generated distortion which can lead to misalignment of stator-rotor air gap 38. To facilitate this process, radially directed holes 40 are provided in an end portion of each leg 36 to accommodate a steel pin 42 in each hole. This process further requires each pin 42 to be aligned with each corresponding hole 44 provided in a lower part of cylindrical section 14. Finally, each pin 42 is spot welded to cylindrical housing section 14 at hole 44.

Turning now to the construction of the scroll compressor mechanism 57, in the upper part of housing 12, is non-orbiting scroll member 46 axially fixed to main bearing 48 by a plurality of bolts 50 in such a manner that orbiting wrap 52, integral with orbiting scroll member 30, and non-orbiting wrap 54, integral with non-orbiting scroll member 46, combine to form compression cavities or chambers 56. Orbiting scroll member 30, non-orbiting scroll member 46 and main bearing 48 comprise compressor mechanism 57 which is positioned in an upper part of cylindrical housing section 14. A typical procedure associated with assembly of compressor 10 includes request for concentricity of inner radial surface 59 of stator 24 respective of inner radial surface 61 of main bearing 48. Annular bushing 32 attached to main bearing 48, by typical means such as press-fit, is substantially concentric with main bearing 48. Main bearing 48 and bushing 32 must also properly align shaft 28 to provide suitable clearance between orbiting and non-orbiting wraps 52 and 54, respectively, so proper compression in compression chambers 56 may be attained. After alignment is achieved, main bearing 48 and/or non-orbiting scroll member 46 is welded to housing 12.

Discharge gas compressed by compressor mechanism 57 flows through discharge port 64 provided with check valve 62, and into first discharge chamber 66. First discharge chamber 66 is defined in part by a volume formed between planar surface 68 of non-orbiting scroll 46 and end cap 16. Thereafter, the discharge gas flows from first discharge chamber 66 to second discharge chamber 70 and exits through discharge tube 72. Discharge chamber 70 is defined by axial surface 78 of compressor mechanism 57, internal surface 33 of a portion of housing 14, generally below compressor mechanism 57, and external surface 55 of the compressor motor 22. Discharge chambers 66 and 70 are in fluid communication through narrow (e.g., 0.035"–0.040"wide) passage 74 formed by internal surface 33 of cylindrical section 14 and peripheral surface 69 of compressor mechanism 57. Discharge tube 72 extends through the wall of cylindrical section 14 of housing 12 and into chamber 70 to transfer refrigerant gas away from compressor assembly 10.

A problem associated with scroll compressors heretofore, is one of excessive noise caused by refrigerant gas turbulently flowing over the compressor mechanism prior to being discharged from the compressor housing. Compressed refrigerant gas exiting discharge port 64 enters first discharge chamber 66, and is thereafter forced over peripheral surface 69 of compressor mechanism 57 and into second discharge chamber 70. Narrow passage 74, disposed between first discharge chamber 66 and second discharge chamber 70, is substantially flow-restrictive and consists of a thin ring or annular shaped passage between cylindrical section 14 of housing 12 and compressor mechanism 57. An outer profile of compressor mechanism 57, exposed to the refrigerant gas flowing thereover, is generally cylindrical, and includes a pair of axially opposed and generally planar surfaces 76, 78, respectively, which are connected by cylindrical surface 80. The transition of discharge gas flow from axial planar surfaces 76, 78, respectively to cylindrical surface 80 generally includes moderately sharp edges which generate turbulence when refrigerant gas flows over compressor mechanism 57. An increase in noise is attributable to an increase in energy of the gas as gas molecules transition from a substantially ordered state to a substantially unorganized and chaotic state. The noise is transmitted through housing 12 of compressor assembly 10 and into the surrounding area.

Another problem associated with compressor assembly 10 arises during operation wherein localized heating occurs between the rotating rotor 26 and the stationary stator 24. Region 25, positioned extending radially through outer peripheral margins of rotor 26 and inner peripheral margins of stator 24, becomes heated which detrimentally affects motor efficiency.

Yet another problem associated with scroll compressors heretofore, is the costly and laborious procedure of aligning the main bearing, auxiliary bearing and stator within the housing to preserve proper scroll wrap and shaft bearing clearances; typically the clearances required are a few ten thousandths of an inch. This procedure is often referred to as "mounting" the compressor.

Mounting of scroll compressors typically requires the diameter of the cylindrical part of the housing to be machined to provide a reference location to concentrically align the main bearing with the auxiliary bearing and to eliminate uneven stator-rotor gap during assembly. Aligning each bearing relative to the housing requires the bearing support structures to include an outer diameter smaller than that of the inner diameter of the cylindrical section of the housing so that a gap is formed between the structure and the inner surface of the housing. The gap must be uniform and somewhat small to facilitate favorable conditions for alignment and spot welding. Further, as mentioned above, typical scroll compressor design mandates precise radial placement of each bearing, thus, a typical scroll compressor exhibits a supporting bearing structure larger than necessary and/or a plurality of special arms attached to the bearing support to allow for radial adjustability. Unfortunately, these design requirements add to the weight of the compressor, complicate assembly and further add to machining time, which in turn, increases the per unit cost to the manufacturer.

Once the bearings and scroll are suitably aligned, the problem of weldability between metals of dissimilar thicknesses and materials must be addressed. For example, welding the relatively thin compressor housing material to the thick bearing support structures often leads to improper joining and/or distortion. Further, often the bearing structures are steel castings, as is the compressor mechanism, while the housing may be formed from cold rolled steel. Those having skill in the art of welding will appreciate that joining by welding depends upon many correlating factors, such as the shape and size of the weld area, material preheat conditions and the speed at which the joined components heat and cool. Distortion of components leads to a complete loss of all materials and labor to that point, often referred to as "scrap", and may be caused by excessive stresses in joined components due to unequal cooling or heating during the welding process. Such undesirable distortion not only resides at the weld location, it also migrates throughout the compressor affecting, for example, precision tolerances such as the bearing gaps, wrap clearances, and the stator-rotor gap.

Therefore, a compressor design which preserves the dimensional tolerances necessary for proper operation of the scroll compressor, which are extremely close, generally on the order of a few ten thousandths of an inch, is highly desirable. Additionally, a design which addresses the difficulties associated with unwanted distortion and stressing of the main bearing, bearing structure, compression mechanism and auxiliary bearing caused by press-fit, shrink-fit and welding is most desirable.

Further, an invention which addresses operational noise, due to discharge gas turbulence internal to the housing, by decreasing the noise without adding significant complexity and cost to the compressor assembly, is highly desirable.

SUMMARY OF THE INVENTION

The present invention overcomes the disadvantages associated with prior compressor assemblies in that it provides a compressor assembly including a housing and a manifold which extends across an interior of the housing subdividing the housing into first and second discharge chambers. The first and second discharge chambers are in fluid communication through the manifold. A compressor mechanism is disposed in the housing and into which a fluid is received substantially at suction pressure and from which the fluid is discharged into the first discharge chamber substantially at discharge pressure. The compressor mechanism is attached to the manifold, whereby the compression mechanism is at least partially supported within the housing. An electric motor including a stator and a rotor is disposed in the second discharge chamber and a shaft operatively couples the rotor with the compressor mechanism.

The present invention further provides a compressor assembly including a housing and a compressor mechanism drivingly coupled to an electric motor by means of a shaft. The compressor mechanism and motor are disposed within the housing and the compressor mechanism receives a fluid substantially at suction pressure. A manifold is attached to the housing and subdivides an interior of the housing into first and second discharge chambers. The manifold has an aperture into which is received a discharge gas discharged from the compressor mechanism and the manifold includes a plurality of chutes which receive the discharge gas from the first discharge chamber and thereafter direct the discharge gas into the second discharge chamber.

The present invention further provides a compressor assembly including a housing having a main section and an end section. The main and end sections of the housing include edges. A bearing support member extends across an interior of the housing, is supported between the edges of the main and end sections of the housing and includes portions projecting radially outward to support the compressor assembly. A compressor mechanism is disposed in the housing and includes means for compressing the fluid from substantially suction pressure to substantially discharge pressure. An electric motor including a stator and a rotor are disposed in the housing. A shaft extends through the rotor and operatively couples the rotor and the compressor mechanism. An auxiliary bearing is disposed about the shaft and supported by the bearing support member. The shaft is rotatably supported by the auxiliary bearing.

The present invention further provides a method of assembling a scroll compressor including the steps of: assembling a main bearing, an orbiting scroll and a non-orbiting scroll to form a compressor mechanism; providing a manifold having a planar surface disposed thereon; fastening the compressor mechanism to the planar surface of the manifold to provide perpendicularity of the planar surface respective of a longitudinal axis through a centerline of the main bearing; providing a main section of the housing having first and second planar edges respectively disposed on axial ends thereof such that corresponding surfaces of first and second planar edges are substantially perpendicular to the longitudinal reference axis passing through the centerline of the housing; attaching a stator to the main section of the housing and aligning the stator therewith such that a centerline of an inner radial surface thereof is substantially aligned with the longitudinal centerline of the main section of the housing; inserting the compressor mechanism into the main section such that the planar surface of the manifold faces the stator and abuts the first planar edge of the main section of the housing; aligning the main bearing with the stator such that a centerline of an inner radial surface of the main bearing is aligned with the centerline of the inner radial surface of the stator; joining the planar surface of the manifold to the first planar edge of the main section; providing a bearing support member having a planar surface disposed thereon; fastening the auxiliary bearing to the bearing support member such that a centerline of an inner radial surface of the auxiliary bearing is substantially perpendicular respective of the planar surface of the bearing support member; providing a rotor coupled to a shaft and disposed within the main section of housing such that the longitudinal axis of the shaft and rotor are substantially coaxially positioned respective of the stator; connecting the auxiliary bearing on an end of the shaft; aligning the rotor within the stator such that the rotor and stator are separated by a substantially uniform and annular gap; joining the planar surface of the bearing support member to the second planar edge of the main section of the housing; and joining a pair of end sections to the housing such that one of the pair of end sections is joined to the housing proximate the first planar edge and the other end section is joined to the second planar edge of the main section of the housing.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction wit the accompanying drawings, wherein.

Figure 1:
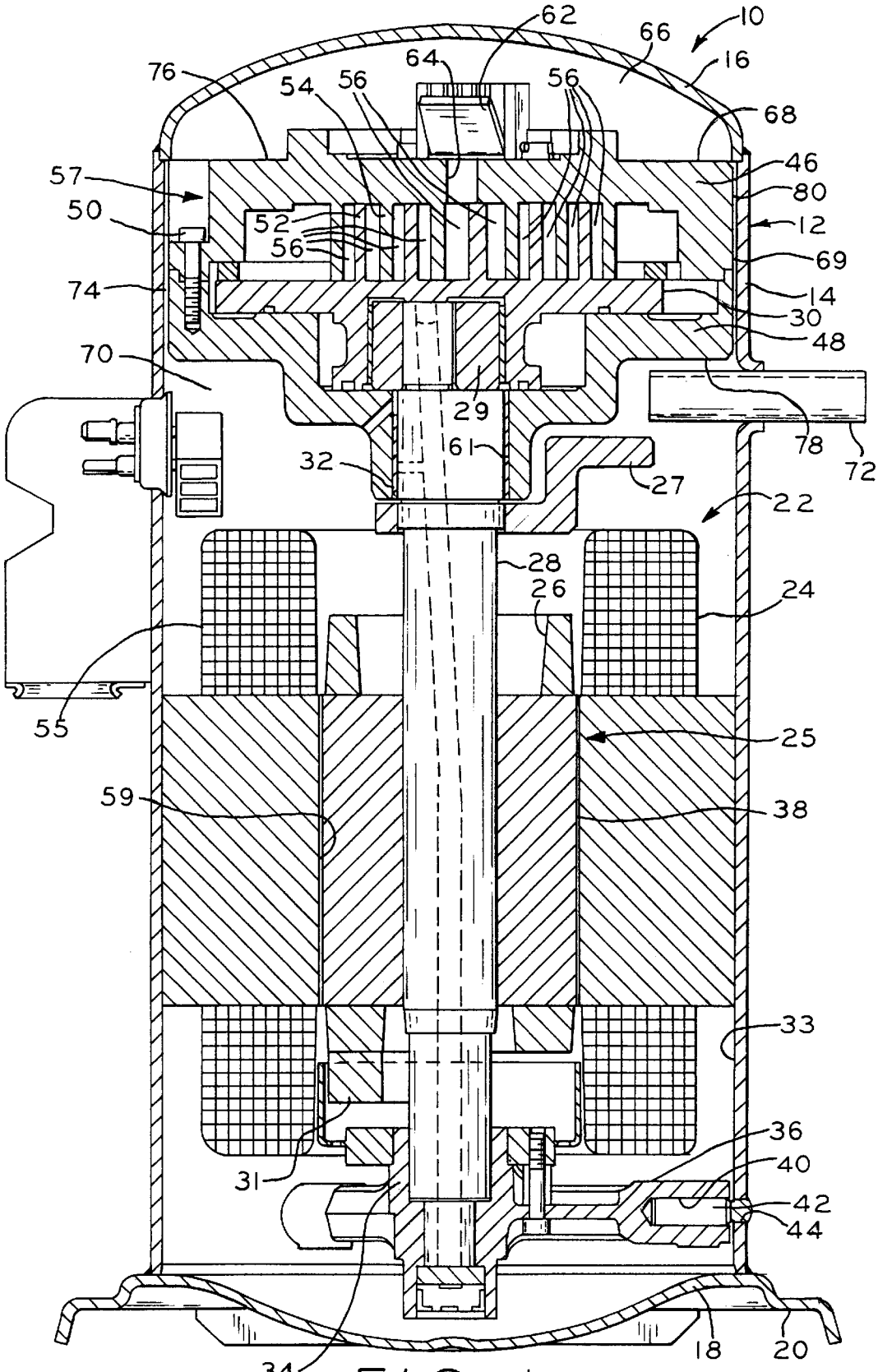
FIG. 1 PRIOR ART
FIG. 1 is a longitudinal sectional view of a prior art compressor assembly.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention in one form thereof, and such exemplification is not to be construed as limiting the scope of the invention in any manner.

DETAILED DESCRIPTION OF THE INVENTION

The present invention overcomes the disadvantages of the above described prior art scroll compressors by providing an improved compressor mounting arrangement requiring fewer components, resulting in less manufacturing time and less assembly required which corresponds to a substantial cost savings. The present invention also provides both a quieter and cooler operating compressor.

Figure 2:
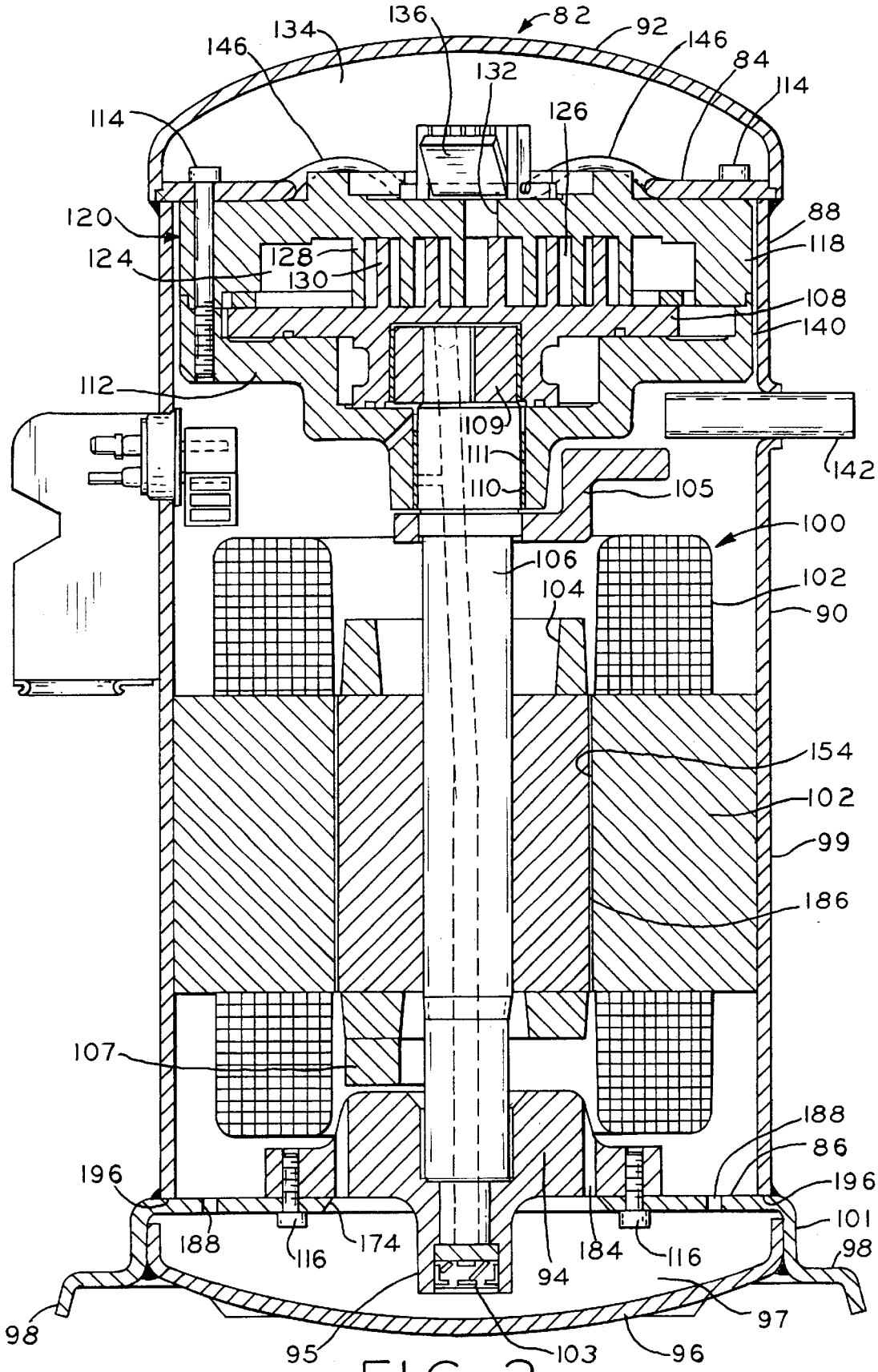
FIG. 2 is a longitudinal sectional view of the compressor assembly according to the present invention.
Figure 3:
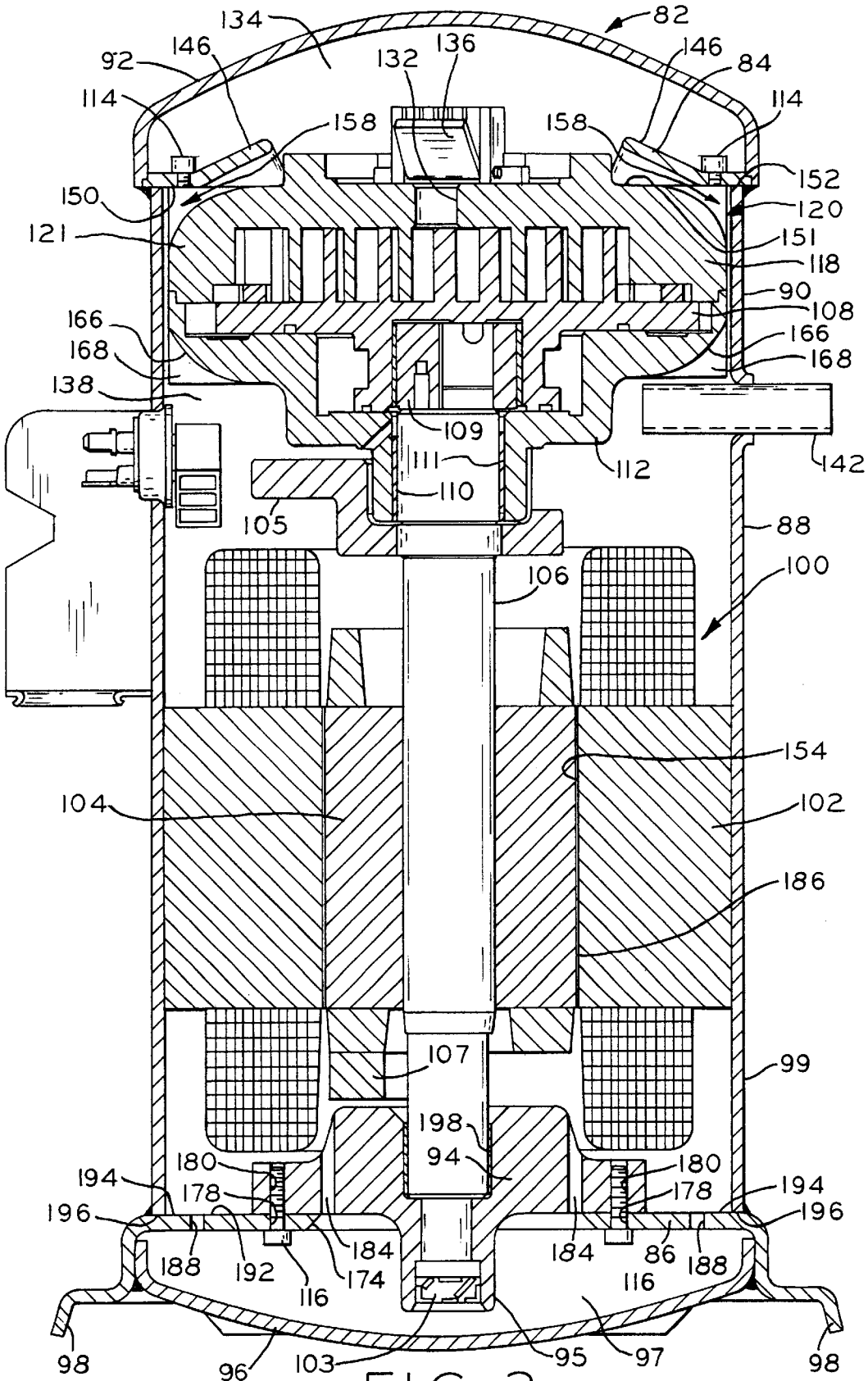
FIG. 3 is a longitudinal sectional view of the compressor assembly of FIG. 2 sectioned through a centerline of the manifold chutes.
Figure 4A:
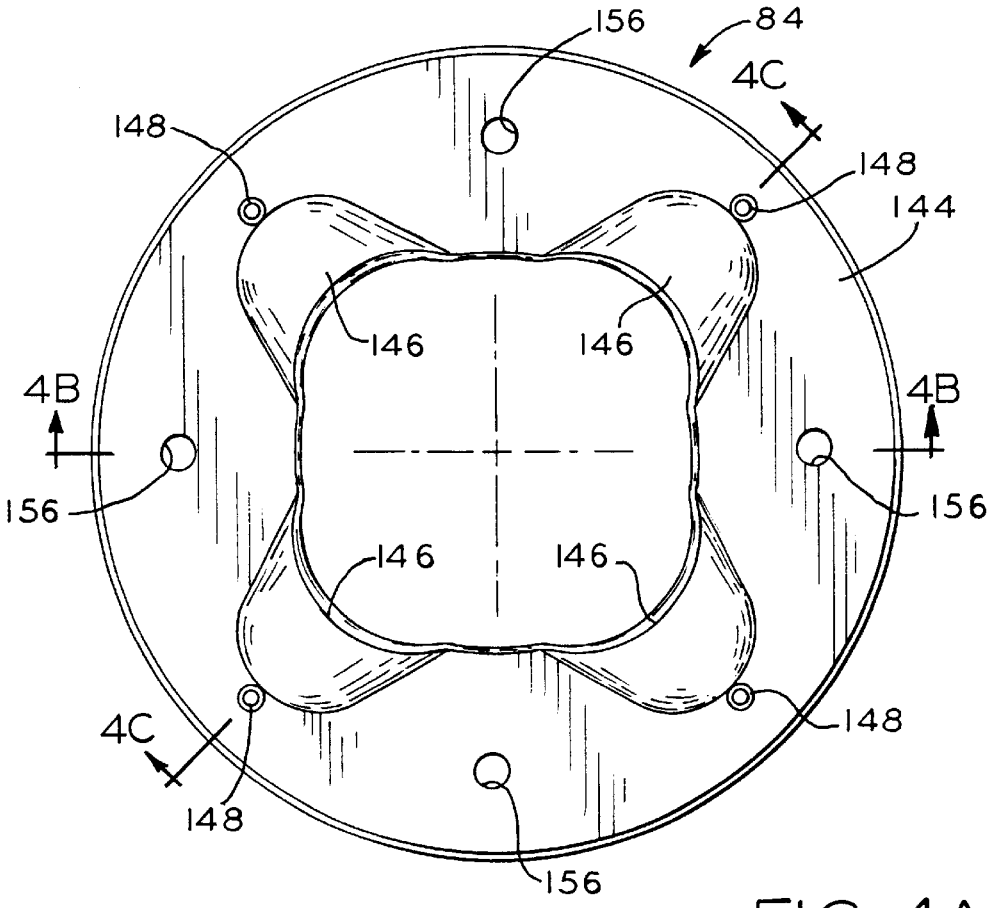
FIG. 4A is a top view of the manifold.
Figure 4B:
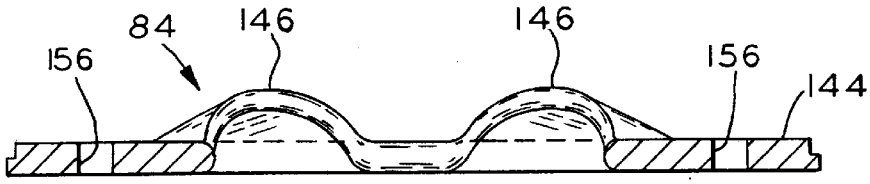
FIG. 4B is a sectional view along line 4B—4B of FIG. 4A.
Figure 4C:
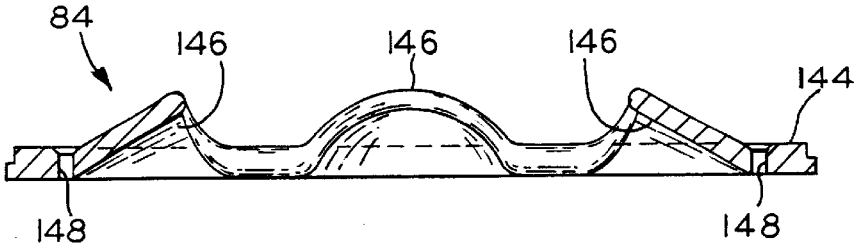
FIG. 4C is a sectional view along line 4C—4C of FIG. 4A.
Figure 5:
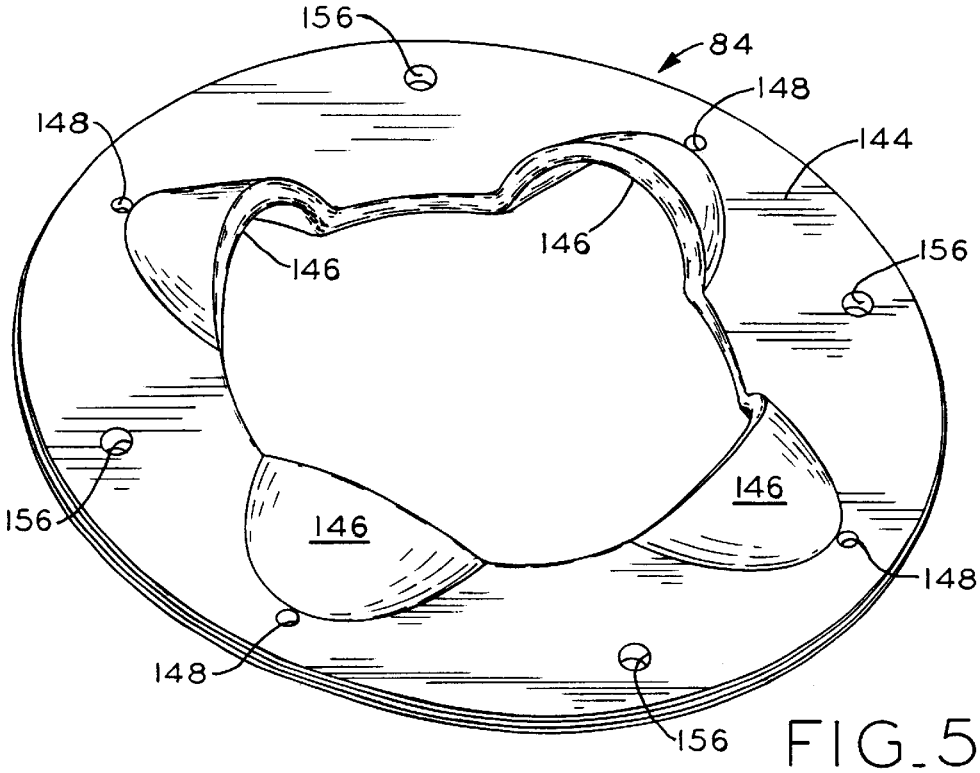
FIG. 5 is a perspective view of the manifold.
Figure 9A:
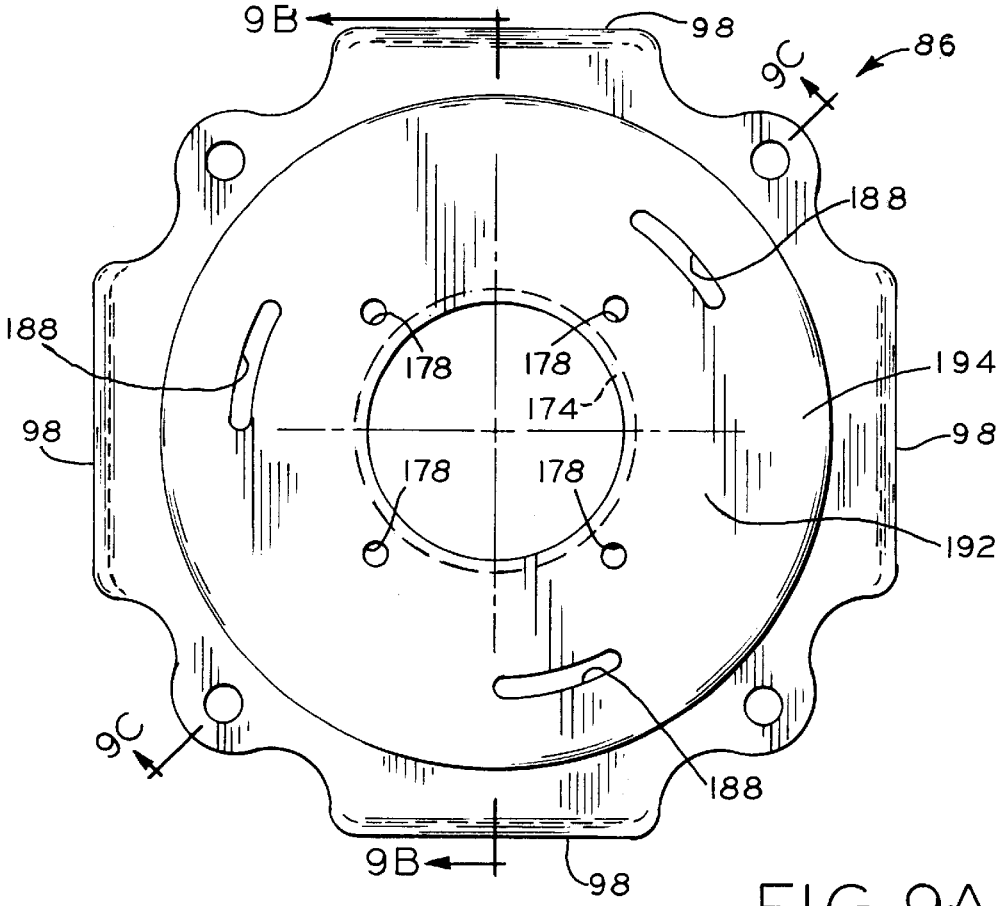
FIG. 9A is a transverse view of the bearing support member.
Figure 9B:
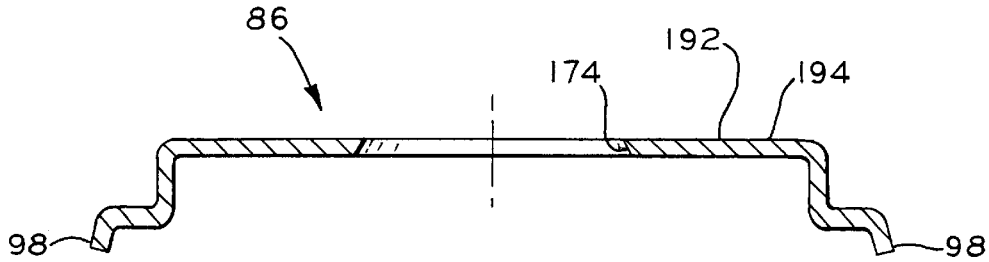
FIG. 9B is a sectional view along line 9B—9B of FIG. 9A.
Figure 9C:
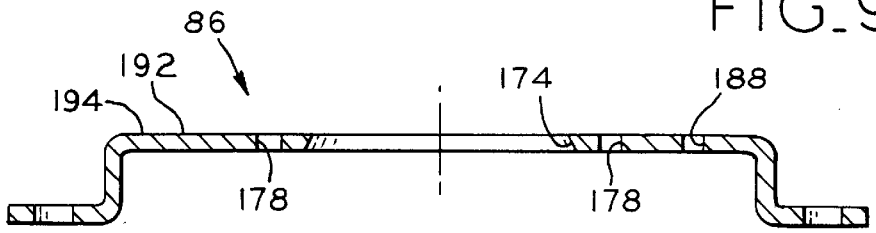
FIG. 9C is a sectional view along line 9C—9C of FIG. 9A.

Referring to FIGS. 2 and 3, compressor assembly 82 of the present invention is shown, and in contrast to the prior art compressor shown in FIG. 1, discloses a noise attenuating manifold and a bearing support structure which are illustrated respectively by manifold 84 and bearing support member 86. Compressor assembly 82 includes closed hermetic housing 88 comprised of main section 90 welded to manifold 84 and having first end section 92 enclosing an upper portion of compressor housing 88 by being welded thereto. In a lower portion of housing 88 is bearing support member 86, which is generally disc-shaped and welded to a lower portion of main section 90 of housing 88 to support auxiliary bearing 94 fastened thereto. Second end section 96 of housing 88, equal in size to the first end section 92, is welded to bearing support member 86 to hermetically enclose housing 88 and provide an oil sump 97. Lower portion 95 of auxiliary bearing 94 extends through bearing support member 86 and into sump 97. Oil pump 103, disposed within lower portion 95 of auxiliary bearing 94, forces oil, pooled within sump 97, through shaft 106 to lubricate compressor mechanism 120 in a well known manner. Formed as a unitary piece is bearing support member 86 including a projecting outer periphery portion comprising a plurality of mounting feet 98 to support compressor assembly 82 (FIGS. 2, 3 and 9B). Hermetic housing 88 is subdivided into two distinct portions by bearing support member 86. First housing portion 99 is disposed above bearing support member 86 and includes motor 100 and compressor mechanism 120 provided therein. Second housing portion 101 is disposed below bearing support member 86 and includes feet 98 of bearing support member 86. Second end section 96 of housing 88 is joined to bearing support member 86 by, for example, welding to form sump 97 which is located generally above second housing portion 101 and below bearing support member 86.

Within main section 90 of housing 88 is electric motor 100 which comprises stator 102 connected to main section 90 by, for example, shrink-fit. Rotor 104 is attached to shaft 106 by press-fit or other like connecting method. At an upper end of compressor assembly 82, shaft 106 drives orbiting scroll 108 through eccentric 109 as is customary. Shaft 106 is supported by main bearing 112, through bushing 110. Counterweight 105 is attached to an upper end of shaft 106 and counterweight 107 is attached to rotor 104, as is customary, to provide substantially balanced rotation of shaft 106. Rotation of shaft 106 is transformed into non-rotating translation of orbiting scroll 108 through known means such as an Oldham coupling. At a lower end of compressor assembly 82, below motor 100, shaft 106 is supported by outboard or auxiliary bearing 94. Annular bushing 110 is connected by press fit with inner radial surface 111 of main bearing 112 to support shaft 106. Non-orbiting scroll 118 is secured between main bearing 112 and manifold 84 by screws 114 (FIG. 2). Auxiliary bearing 94 is fastened to bearing support member 86 by screws 116. Non-orbiting scroll 118, orbiting scroll 108 and main bearing 112 form compressor mechanism 120.

Figure 7:
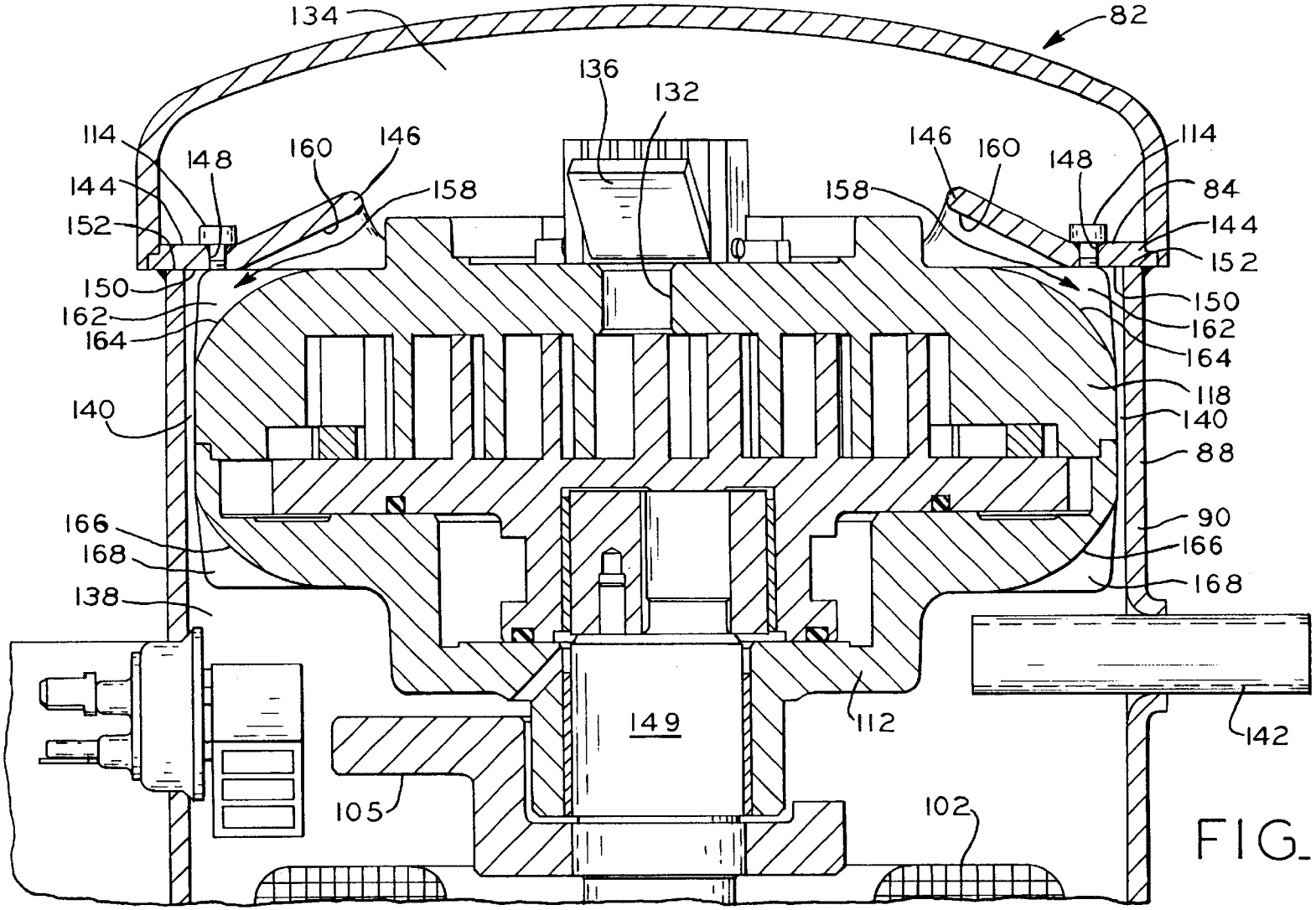
FIG. 7 is an enlarged fragmentary view of the compressor assembly shown in FIG. 3, showing the scroll compressor mechanism and the manifold.

Referring to FIGS. 2, 3 and 7, in operation, electric motor 100 drives compressor mechanism 120 to compress refrigerant gas, introduced into inlet port 122 (FIG. 8) at suction pressure, within compression chamber 124. Compression chamber 124 is defined by a plurality of compression cavities 126 positioned between non-orbiting involute wrap element 128 and orbiting involute wrap element 130. Thus, orbiting involute wrap element 130, driven by motor 100, orbits about non-orbiting involute wrap element 128 to compress refrigerant gas therebetween.

Figure 8:
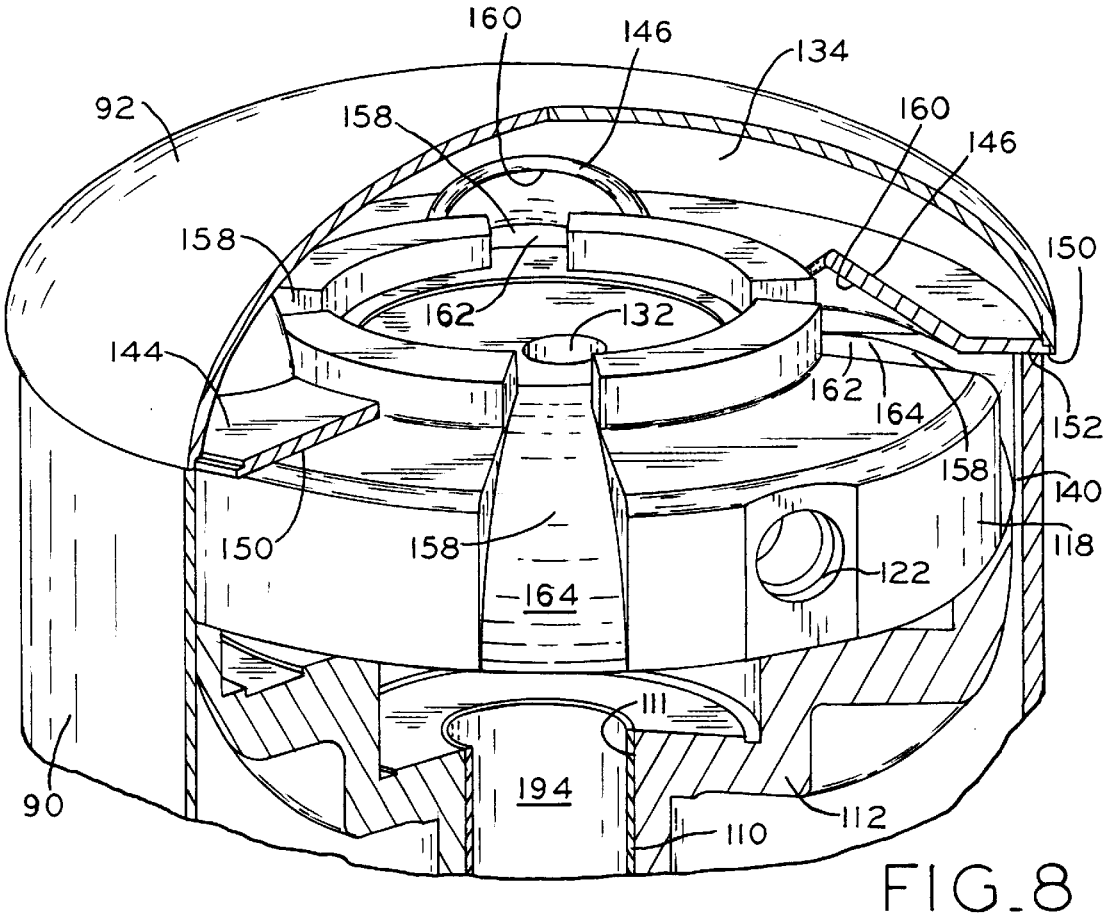
FIG. 8 is a fragmentary perspective view of the compressor assembly shown in FIG. 7 with a portion thereof broken away.

Compressed refrigerant gas, at its final compressed state (substantially at discharge pressure), exits compressor cavities 126 through discharge port 132 (FIGS. 2, 3, 6A, 6B, 7 and 8) then flows into first discharge chamber 134 through check valve 136. Check valve 136 prevents compressed refrigerant from reversing or flowing back into port 132 from first discharge chamber 134 to help prevent reverse orbiting of the orbiting scroll. Refrigerant gas flows from first discharge chamber 134 to second discharge chamber 138 through four radial projecting semi-circular chutes 146 disposed within manifold 84. Four jets of discharge gas, in fluid communication with chutes 146, are directed through passages 158 (FIGS. 7 and 8). Notably, and as best seen in FIGS. 7 and 8, annular gap 140, a thin ring defined by an interior wall of housing 88 and the exterior peripheral surface of compressor mechanism 120, is otherwise flow restrictive when refrigerant gas is discharged from first discharge chamber 134 to second discharge chamber 138, however, compressor mechanism 120 includes channels 162 to accommodate increased flow. Compressor assembly 82 includes four channels 162, formed in surface 151 of non-orbiting scroll 118 in compressor mechanism 120, positioned adjacent annular gap 140 (FIG. 2). Channels 162 decrease the axial length of annular gap 140, along the exterior of compressor mechanism 120 which increases the flow of discharge gas otherwise restricted by substantially cylindrical compressor mechanism 120.

Referring to FIGS. 2 and 3, compressor assembly 82 includes discharge manifold 84 attached to compressor mechanism 120 and welded to main section 90 of housing 88. Main bearing 112 includes bushing 110 fitted therein to receive rotating drive shaft 106 and main bearing 112 is attached by way of screws 114 (FIG. 7) to non-orbiting scroll 118. Nonorbiting scroll 118 includes discharge port 132 (FIGS. 6A and 6B) therein to provide an exit for compressed refrigerant gas to exit compressor mechanism 120. Refrigerant gas, contained within first discharge chamber 134, is transferred to second discharge chamber 138 by flowing over an exterior of compressor mechanism 120. Typical compressor mechanisms are "cylinder-shaped" (FIG. 1) and in contrast, compressor mechanism 120 includes four equidistantly arranged channels 162 forming generally round-edged axial cross-section 121 (FIG. 3). The channels 162 are positioned adjacent the four discharge chutes 146 disposed on manifold 84, to promote an increased boundary layer of refrigerant gas flow between each channel 162 and respective chute 146. The refrigerant gas then flows into second discharge chamber 138 and exits housing 88 through discharge pipe 142 (FIGS. 2 and 3).

Referring to FIGS. 4A–4C and 5, manifold or muffler plate 84 may be integrally formed by, for example, cold forming a steel plate through a stamping process, to form an annular, one piece unit which serves as a muffler to attenuate noise created by discharge gas. Additionally, manifold 84 serves as a structure to support the compressor mechanism. Manifold 84 is generally a disc shaped member having a generally circular base portion 144. Manifold 84 includes four semi-circular chutes 146, extending radially and arranged symmetrically about, and equidistantly from, the center of base portion 144. However, it is envisioned that an asymmetrical arrangement of chutes 146 would also provide suitable noise attenuation. Non-orbiting scroll 118 is secured to manifold 84 by screws 114 which extend through holes 148 in manifold 84 and thread into non-orbiting scroll 118 (FIGS. 2, 3 and 7).

Referring to FIGS. 2, 7 and 8, which best show the manifold's attachment to housing 88, manifold 84 includes base 144 having machined surface 150, defining a reference surface which is substantially perpendicular to a centerline of radial inner surface 149 of bushing 110, which is substantially concentric with a radial inner surface of main bearing 112. Surface 150 is adapted to abuttingly contact correspondingly machined annular top edge 152 of housing 88. Surface 150 also defines a plane which is substantially perpendicular to a centerline axis of inner radial surface 154 of stator 102 within main section 90 of housing 88 (FIGS. 2 and 3). Surface 150 of manifold 84 is welded to annular top edge 152 of housing 88. Stator 102 is fixed to housing 88 by way of, for example, shrink-fitting. Holes 156 (FIGS. 4A–4C and 5) in manifold 84 provide oil passages between first discharge chamber 134 and sump 97 to allow oil accumulated in first discharge chamber 134 to be reclaimed by oil sump 97 (FIGS. 2 and 3).

Figure 6A:
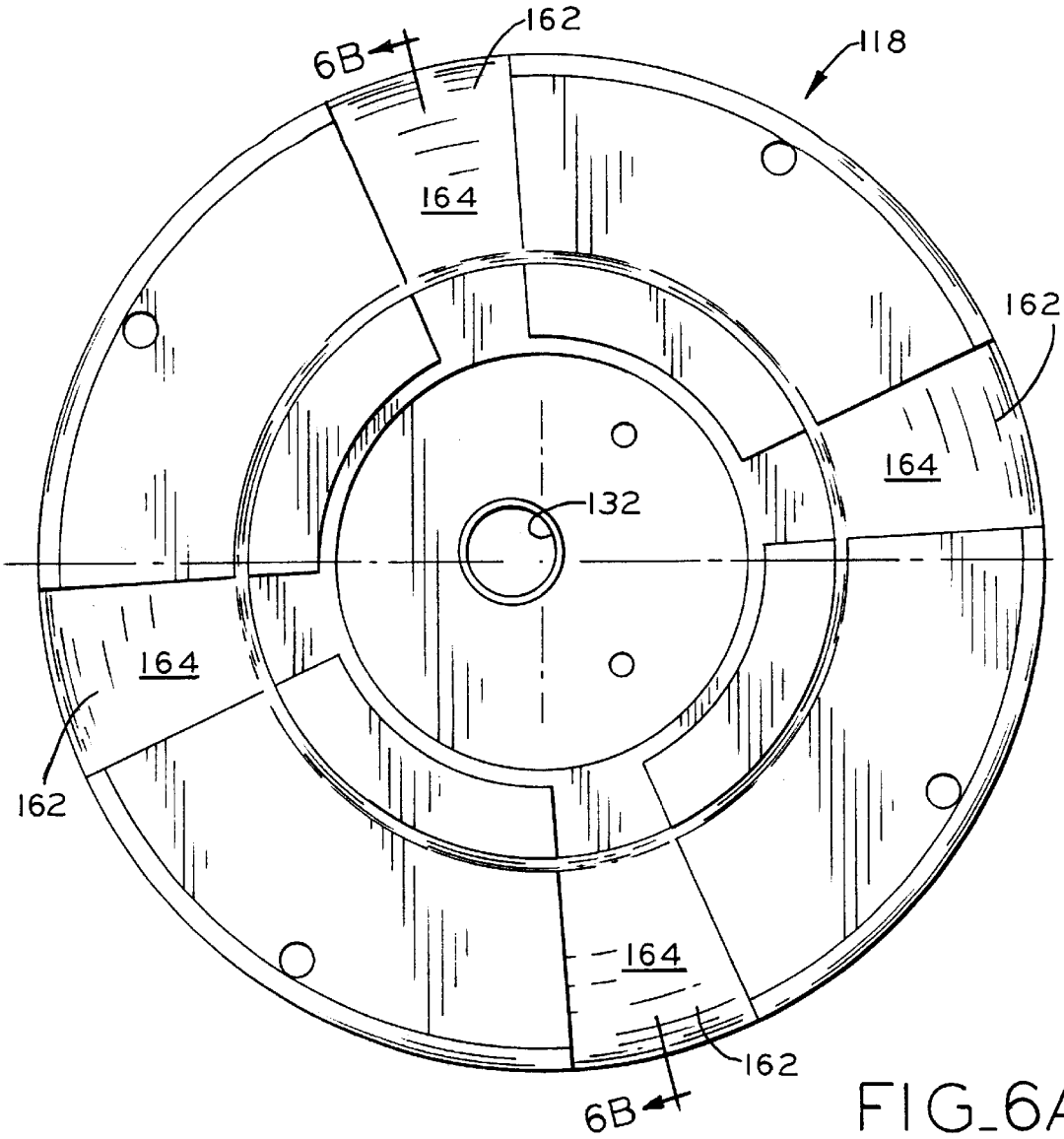
FIG. 6A is a top view of a fixed scroll.
Figure 6B:
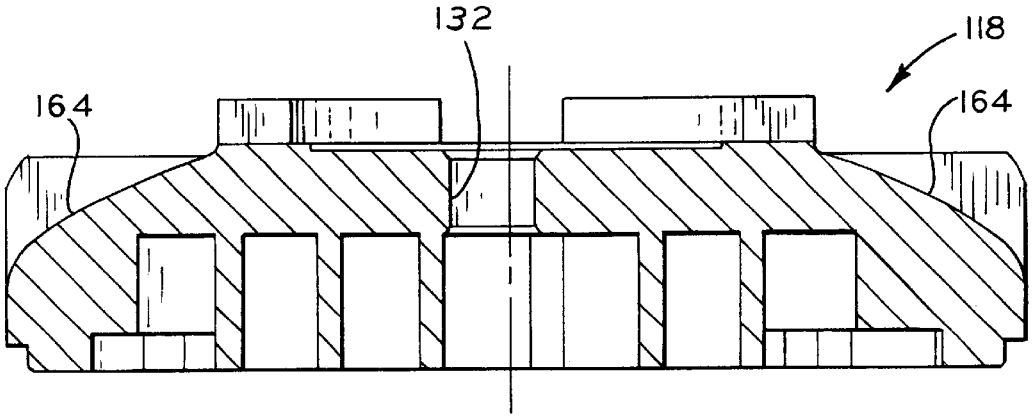
FIG. 6B is a sectional view along line 6B—6B of FIG. 6A.

Referring to FIGS. 6A, 6B, 7 and 8, further describing the operation of manifold 84 and compressor mechanism 57, compressed refrigerant gas is discharged from discharge port 132 and into first discharge chamber 134 through check valve 136 (not shown in FIG. 8). The gas then flows through a first portion of four passages 158 (FIGS. 7 and 8), each formed by inner wall surface 160 of each chute 146 and respective surface 164 of each channel 162 within non-orbiting scroll 118 (FIGS. 6A, 6B and 7). Surface 164 of each channel 162 follows a generally semi-circular exterior profile of non-orbiting scroll 118 and provides a generally smooth and unobtrusive path for the refrigerant gas to flow from first discharge chamber 134 to a second portion of passages 158. A second portion of passages 158 abut channels 162 in non-orbiting scroll 118 and are formed in main bearing 112. Four equidistantly arranged channels 168 having respective surfaces 166 are disposed within exterior surface portions of main bearing 112. Each channel 168, provided in main bearing 112, abuts channel 162, in non-orbiting scroll 118, such that channel 162 continuously extends into channel 168. Refrigerant gas is directed from first discharge chamber 134 to second discharge chamber 138 through passages 158 by remaining attached, as a gas layer having a boundary, to channels 162, 168, and inner wall surfaces 160 of chutes 146. This attachment of gas, known to those having skill in the art as a "Coanda effect", involves attachment of high velocity fluid to a surface. As best seen in FIGS. 3 and 7, passages 158 are continuous along exterior portions of the generally oval cross-section of compressor mechanism 120 (FIG. 3). Further, the refrigerant gas remains attached, under a Coanda effect from surface 164 of fixed scroll 118 to surface 166 of main bearing 112 and is thereafter directed to electric motor 100. Flow of refrigerant gas directed to motor 100 decreases heat generated in windings and increases performance of the compressor assembly 82.

Referring to FIGS. 3, 7 and 8, noise attenuation, associated with fluid flow through compressor assembly 82, is achieved by the discharge gas being directed through multiple passages 158. A single jet of discharge gas, exiting discharge port 132 of non-orbiting scroll 118, has associated therewith a particular energy level, a portion of which manifests itself in the form of audible noise. This energy level, and associated noise, may be reduced by segmenting and segregating the single jet into multiple smaller jets which imparts a significant energy loss on the aggregate discharge flow. Additionally, discharge flow noise may be further decreased by directing discharge gas flow over generally curved and gradually sloped walls defining arcuate passages, e.g., the inner wall surfaces 160 of chutes 146 and surfaces 164, 166 of respective channels 162, 168 defining flow passages 158, to prolong the boundary layer attachment of discharge gas flow to aforesaid surfaces. Increasing boundary layer attachment acts to further diminish the noise associated with flow turbulence.

Compressor assembly 82 includes motor 100 comprised of rotational rotor 104 and stationary stator 102 separated by rotor-stator air gap 186. Heat generated from friction and current flow through motor windings adversely affects motor performance. The generated heat is reduced by utilizing the Coanda effect, i.e., discharge gas attached to surface 166 of compressor mechanism 120 disattaches and is directed toward motor 100 to cool the motor windings. This cooling effect increases motor efficiency and increases performance of the compressor.

Turning now to the mounting structure of the present invention, as best seen in FIGS. 2 and 3, compressor assembly 82 includes auxiliary bearing 94 mounted in a lower part of housing 88. Auxiliary bearing 94 is fastened to bearing support member 86 and bearing support member 86 is attached to housing 88. Bearing support member 86 has a plurality of mounting feet 98 integrally formed by, for example, a cold forming process such as stamping, which support compressor assembly 82 in a generally upright or vertical position. As best seen with reference to FIGS. 3 and 9A, bearing support member 86 has clearance hole 174 to accommodate a lower portion 176 of auxiliary bearing 94. Four holes 178 in bearing support member 86 align with corresponding threaded holes 180 in bearing 94 to receive screws 116 therein to fasten auxiliary bearing 94 to bearing support member 86. Auxiliary bearing 94 has a plurality of arcuate apertures 184 which are aligned with the rotor-stator air gap 186 of motor 100 to provide adjustability of gap 186 through clearance hole 174 in bearing support member 86 following assembly of compressor mechanism 120 with main section 90 of housing 88 (FIGS. 2 and 3). A portion of oil transferred with the discharge gas, otherwise accumulating on bearing support member 86, is transferred to sump 97 through apertures 188 in bearing support member 86 (FIGS. 2, 3 and 9A). Also, oil dispersed within refrigerant gas, which may accumulate within rotor-stator air gap 186, is reclaimed by oil sump 97 through arcuate apertures 184 in auxiliary bearing 94.

Referring to FIGS. 3 and 9A–9C, bearing support member 86 includes surface 192 which has peripheral shoulder portion 194 adapted to abut edge surface 196 of main section 90 of housing 88. Edge surface 196 is machined and abuts shoulder portion 194 of surface 192 of bearing support member 86 such that edge surface 196 is substantially perpendicular to a centerline axis of inner radial surface 154 of stator 102 (FIGS. 2 and 3).

Referring to FIG. 3, a method of assembly of compressor assembly 82 which minimizes distortion of the main bearing, auxiliary bearing and scroll wraps, during heating and cooling processes associated with welding will be discussed. The process of assembly of compressor assembly 82 includes the steps of: assembling main bearing 112 (after press fit of bushing 110 therein), orbiting scroll 108 and non-orbiting scroll 118 to form compressor mechanism 120; machining planar surface 150 of manifold 84 to establish perpendicularity of a reference plane disposed on surface 150 to an axial centerline of main bearing 112 whereby planar surface 150 is used as the reference for locating rotor 104 vertically; fastening manifold 84 to top portion 151 of compressor mechanism 120; machining end surfaces 152, 196 respectively of main section 90 of housing 88 to provide substantially parallel surfaces with respect to each other and substantially perpendicular to an axis passing through the centerline of inner radial surface of stator 154; shrink-fitting stator 102 into main section 90 of housing 88 whereby a first planar edge 152 of main section 90 provides a reference for locating stator 102 vertically; inserting compressor mechanism 120 into housing such that surface 150 of manifold 84, facing stator 102, abuts the corresponding first planar edge 152 of main section 90; inserting a mandrel, or dummy rotor, into a cavity of stator 102 to concentrically align main bearing 112 with stator 102; spot welding manifold 84 to main housing section 90; machining peripheral surface 192 of bearing support member 86 to provide substantial perpendicularity between peripheral surface 192 and a centerline axis with respect to an inner radial surface 198 of auxiliary bearing 94; fastening auxiliary bearing 94 to bearing support member 86; inserting a shaft 106 coupled to a rotor 104 into the stator 102 and fitting the auxiliary bearing 94 onto an end of the shaft until planar surface of bearing support member 86 abuts second planar edge of main section of housing; inserting gages into apertures 184 within auxiliary bearing 94 to set gap 186 between stator 102 and rotor 104; providing a continuous weld to join bearing support member 86 with main section 90 of housing 88; and welding end sections 92, 96 to each respective end 152, 86 of housing 88 to sealably enclose housing 88.

While this invention has been described as having an exemplary embodiment, the present invention may be further modified within the spirit and scope of this disclosure. This application is therefore intended to cover any variations, uses, or adaptations of the invention using its general principles. For example, aspects of the present invention may be applied to rotary compressors. Further, this application is intended to cover such departures from the present disclosure as come within known or customary practice in the art to which this invention pertains.

What is claimed is:

1. A compressor assembly comprising:

a housing;

a manifold having an aperture therethrough, said manifold extending across an interior of said housing subdividing said housing into first and second discharge chambers, said first and second discharge chambers in fluid communication through said aperture in said manifold;

a compressor mechanism disposed in said housing and into which a fluid is received substantially at suction pressure and from which the fluid is discharged into said first discharge chamber substantially at discharge pressure, said compressor mechanism attached to said manifold, whereby said compression mechanism is at least partially supported within said housing by said manifold;

an electric motor comprising a stator and a rotor disposed in said second discharge chamber; and a shaft operatively coupling said rotor and said compressor mechanism.

2. The compressor assembly of claim 1, wherein said manifold constitutes a muffler.

3. The compressor assembly of claim 1, wherein said compressor mechanism comprises a fixed scroll member attached to said manifold and having a fixed involute wrap element projecting from a substantially planar surface thereof, and an orbiting scroll member operatively coupled to said shaft and having an orbiting involute wrap element projecting from a substantially planar surface thereof, said fixed and orbiting scroll members mutually engaged with said fixed involute wrap element projecting towards said substantially planar surface of said orbiting scroll member, and said orbiting involute wrap element projecting towards said substantially planar surface of said fixed scroll member, said substantially planar surfaces positioned substantially parallel with one another, whereby relative orbiting of said scroll members compresses the fluid between said involute wrap elements, said fixed scroll member having a discharge port which extends from a space between said involute wrap elements to said first discharge chamber.

4. The compressor assembly of claim 1, wherein said aperture is substantially centrally located in said manifold.

5. The compressor assembly of claim 1, wherein the fluid is discharged from said compressor mechanism through said manifold aperture.

6. The compressor assembly of claim 5, wherein said manifold is provided with a plurality of projections distributed about said aperture, said projections partially defining a plurality of chutes through which said first and second discharge chambers are in fluid communication.

7. The compressor assembly of claim 6, wherein said plurality of projections extend into said first discharge chamber.

8. The compressor assembly of claim 7, wherein said plurality of projections are radially and equidistantly distributed about said aperture.

9. The compressor assembly of claim 7, wherein said manifold directs the fluid which is received into said second discharge chamber from said first discharge chamber toward said stator.

10. The compressor assembly of claim 7, wherein said compressor mechanism includes a plurality of channels disposed on a periphery of said compressor mechanism, said first and second discharge chambers are in fluid communication through said plurality of channels.

11. The compressor assembly of claim 10, wherein each said plurality of projections include an inner surface and each said plurality of channels defines a surface, each inner surface of said projection and respective said surface of said channel define a passage to receive the discharge gas.

12. The compressor assembly of claim 11, wherein the fluid received into said second discharge chamber from said first discharge chamber is directed along said plurality of channels and towards said stator under the influence of a Coanda effect.

13. The compressor assembly of claim 12, wherein said compressor mechanism constitutes a scroll compressor including a fixed scroll mounted to a main bearing, each said plurality of channels is continuous and defined by a sub-channel formed within a radially exterior surface of said fixed scroll and contiguous with a sub-channel formed within an exterior surface of said main bearing.

14. The compressor assembly of claim 1, further comprising means for subdividing the flow of the fluid substantially at discharge pressure which is received into said first discharge chamber into a plurality of jets.

15. The compressor assembly of claim 14, wherein said means for subdividing the flow further comprises means for minimizing the turbulence of the flow of the fluid substantially at discharge pressure which is received into said first discharge chamber, whereby the noise associated with the flow of fluid substantially at discharge pressure is reduced.

16. A compressor assembly comprising:

a housing;

a compressor mechanism drivingly coupled to an electric motor by means of a shaft, said compressor mechanism and motor disposed within said housing and said compressor mechanism receiving a fluid substantially at suction pressure; and a manifold attached to said housing and subdividing an interior of said housing into first and second discharge chambers, said manifold having an aperture into which is received a discharge gas discharged from said compressor mechanism disposed within said second discharge chamber, said manifold including a plurality of chutes;

said compressor mechanism including a plurality of channels disposed on a peripheral surface and each channel positioned adjacent the respective chute, each said channel defining a generally arcuate profile extending between a pair of substantially planar axial end surfaces defining said compressor mechanism.

17. The compressor assembly of claim 16, wherein each said chute in said manifold includes an inner surface and each said channel in said peripheral surface of said compressor mechanism defines a surface, each said inner surface of said chute and respective said surface of said channel defines a passage.

18. The compressor assembly of claim 16, wherein one of said pair of axial end surfaces of said compressor mechanism includes a discharge port and is attached to said manifold, said shaft extending axially and outwardly from the other said axial end surface.

19. The compressor assembly of claim 16, wherein said compressor mechanism constitutes a scroll compressor having a fixed scroll, a main bearing and an orbiting scroll, said peripheral surface being defined by exterior portions of said main bearing and said fixed scroll, fluid received into said second discharge chamber from said first discharge chamber is directed along said peripheral surface under the influence of a Coanda effect.

20. The compressor assembly of claim 19, wherein fluid is further directed from said peripheral surface of said compressor mechanism to said electric motor under the influence of a Coanda effect, whereby heat generated by said motor is decreased.

21. A compressor assembly comprising:

a housing comprising a main section and an end section, said main and end sections of said housing including edges;

a bearing support member extending across an interior of said housing and supported between said edges of said main and end sections of said housing, said bearing support member having portions projecting radially outward to support the compressor assembly;

a compression mechanism disposed in said housing and comprising means for compressing the fluid from substantially suction pressure to substantially discharge pressure;

an electric motor comprising a stator and a rotor disposed in said housing, an air gap is disposed between said stator and rotor;

a shaft extending through said rotor and operatively coupling said rotor and said compressor mechanism; and an auxiliary bearing disposed about said shaft and supported by said bearing support member, said shaft rotatably supported by said auxiliary bearing.

22. The compressor assembly of claim 21, wherein said shaft is vertically positioned and said bearing support member includes radially outward portions which extend to the exterior of said housing and define a plurality of feet, said compressor assembly supported by said feet.

23. The compressor assembly of claim 21, wherein said bearing support member is substantially disc-shaped.

24. The compressor assembly of claim 22, wherein said bearing support member is provided with a clearance hole, said auxiliary bearing extending through said clearance hole.

25. The compressor assembly of claim 24, further comprising an oil sump at least partially defined by the interior of said housing, said auxiliary bearing at least partially located in said oil sump.

26. The compressor assembly of claim 25, wherein said bearing support member is located above said oil sump.

27. The compressor assembly of claim 25, wherein said bearing support member includes a planar portion substantially extended radially across said housing whereby said planar portion prevents oil in said sump from being suctioned into said air gap.

28. The compressor assembly of claim 22, wherein said oil sump is located above said second housing portion.

29. The compressor assembly of claim 22, further comprising an oil pump disposed in said sump and located within said auxiliary bearing.

30. The compressor assembly of claim 29, wherein an inlet to said oil pump is located between said bearing support member and said second housing portion.

31. The compressor assembly of claim 30, wherein said bearing support member is provided with a plurality of apertures through which oil flows toward said oil pump inlet.

32. The compressor assembly of claim 31, wherein said shaft has an axis of rotation and said auxiliary bearing is provided with a plurality of apertures extending therethrough in directions substantially parallel with said shaft axis of rotation, each said aperture aligns with and overlays said air gap between said rotor and said stator, whereby inspection of the width of said gap is facilitated by said apertures.

33. The compressor assembly of claim 32, wherein said apertures within said auxiliary bearing align with and overlay said clearance hole in said bearing support member, whereby oil dispensed within the discharge gas and disposed within said rotor-stator air gap is directed to said oil sump through said apertures within said auxiliary bearing and through said clearance hole.

34. A method of assembling a scroll compressor comprising the steps of:

assembling a main bearing, an orbiting scroll and a non-orbiting scroll to form a compressor mechanism;

providing a manifold having a planar surface disposed thereon;

fastening the compressor mechanism to the planar surface of the manifold to provide perpendicularity of the planar surface respective of a longitudinal axis through a centerline of the main bearing;

providing a main section of the housing having first and second planar edges respectively disposed on axial ends thereof such that corresponding surfaces of first and second planar edges are substantially perpendicular to a longitudinal reference axis passing through the centerline of the housing;

attaching a stator to the main section of the housing and aligning the stator therewith such that a centerline of an inner radial surface thereof is substantially aligned with the longitudinal centerline of the main section of the housing;

inserting the compressor mechanism into the main section such that the planar surface of the manifold faces the stator and abuts the first planar edge of the main section of the housing;

aligning the main bearing with the stator such that a centerline of an inner radial surface of the main bearing is aligned with the centerline of the inner radial surface of the stator;

joining the planar surface of the manifold to the first planar edge of the main section;

providing a bearing support member having a planar surface disposed thereon;

fastening the auxiliary bearing to the bearing support member such that a centerline of an inner radial surface of the auxiliary bearing is substantially perpendicular respective of the planar surface of the bearing support member;

providing a rotor coupled to a shaft and disposed within the main section of housing such that the longitudinal axis of the shaft and rotor are substantially coaxially positioned respective of the stator;

connecting the auxiliary bearing on an end of the shaft;

aligning the rotor within the stator such that the rotor and stator are separated by a substantially uniform and annular air gap;

joining the planar surface of the bearing support member to the second planar edge of the main section of the housing; and joining a pair of end sections to the housing such that one of the pair of end sections is joined to the housing proximate the first planar edge and the other end section is joined to the second planar edge of the main section of the housing.

* * * * *